US010872500B2

(12) United States Patent
Peterson et al.

(10) Patent No.: US 10,872,500 B2
(45) Date of Patent: Dec. 22, 2020

(54) SLOT MACHINE IMPLEMENTING A SYMBOL LOCK OPERATION

(71) Applicant: IGT, Las Vegas, NV (US)

(72) Inventors: Chris Peterson, Reno, NV (US); Nick Hillstrom, Reno, NV (US); Nathan Ajhar, Sparks, NV (US); Yu Chong, Reno, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 16/353,691

(22) Filed: Mar. 14, 2019

(65) Prior Publication Data

US 2020/0294361 A1 Sep. 17, 2020

(51) Int. Cl.
*G07F 17/32* (2006.01)
*G07F 17/34* (2006.01)

(52) U.S. Cl.
CPC ..... *G07F 17/3265* (2013.01); *G07F 17/3213* (2013.01); *G07F 17/34* (2013.01)

(58) Field of Classification Search
None
See application file for complete search history.

(56) References Cited

U.S. PATENT DOCUMENTS 7,371,173 B2 * 5/2008 Gatto ..... G07F 17/32 273/143 R
7,393,278 B2 * 7/2008 Gerson ..... G07F 17/32 273/138.2
8,366,533 B1 * 2/2013 Nicely ..... G07F 17/3244 463/16
8,608,543 B2 * 12/2013 Cuddy ..... G07F 17/3239 463/16
2004/0053657 A1 * 3/2004 Fiden ..... G07F 17/32 463/16
2004/0063483 A1 * 4/2004 Wolf ..... G07F 17/3227 463/13
2004/0140618 A1 * 7/2004 Fox ..... G07F 17/3262 273/292
2005/0215311 A1 * 9/2005 Hornik ..... G07F 17/32 463/20
2006/0068884 A1 * 3/2006 Baerlocher ..... G07F 17/3244 463/20
2006/0160595 A1 * 7/2006 Gerson ..... G07F 17/32 463/16
2008/0108409 A1 * 5/2008 Cole ..... G07F 17/3265 463/20
2008/0318660 A1 * 12/2008 Nores ..... G07F 17/32 463/20
2009/0191946 A1 * 7/2009 Thomas ..... G07F 17/32 463/20
2009/0305768 A1 * 12/2009 McKay ..... G07F 17/3209 463/20
2011/0111824 A1 * 5/2011 Cuddy ..... G07F 17/3239 463/20

(Continued)

*Primary Examiner* — Seng H Lim
(74) *Attorney, Agent, or Firm* — Sheridan Ross P.C.

(57) ABSTRACT

The present disclosure relates generally to computational devices and, in particular, toward a computational device, system, and method of operating a computational device. The method may include determining that a re-spin operation is available with a symbol lock feature and then implementing the re-spin for symbols in an array of symbols that are unlocked or otherwise not identified as being locked.

18 Claims, 15 Drawing Sheets

(56) References Cited

U.S. PATENT DOCUMENTS

| | | | | |
|---|---|---|---|---|
| 2014/0011569 | A1* | 1/2014 | Saunders | G07F 17/34 463/21 |
| 2014/0171175 | A1* | 6/2014 | Taylor | G07F 17/32 463/20 |
| 2015/0348355 | A1* | 12/2015 | Caputo | G07F 17/3227 463/31 |
| 2016/0110947 | A1* | 4/2016 | Eisenmann | G07F 17/3265 463/21 |
| 2018/0190080 | A1* | 7/2018 | Washington | G07F 17/3209 |
| 2019/0347905 | A1* | 11/2019 | Pate | G07F 17/3293 |

* cited by examiner

SLOT MACHINE IMPLEMENTING A SYMBOL LOCK OPERATION

BACKGROUND

The present disclosure is directed toward a slot machine and, in particular, a slot machine that implements a symbol lock operation.

Gaming machines are constantly trying to provide improved game play features to improve the overall player experience. Any type of game play feature that presents the player with an additional opportunity to win is often viewed as desirable and can lead to increased play of the gaming machine.

BRIEF SUMMARY

In certain embodiments, the present disclosure relates to a method of operating a computational device, including: initiating a first reel spin in which a random number generator is used to determine a position of a first reel and a second reel after spinning the first reel and the second reel; after the first reel spin, displaying a first set of symbols with the first reel and a second set of symbols with the second reel; after the first reel spin, determining, with a processor of the computational device, that a re-spin is available; determining, with the processor, that a symbol lock function will be implemented during the re-spin; selecting, with the processor and in response to determining that the symbol lock function will be implemented, the first reel to remain locked during the re-spin; initiating the re-spin in which the random number generator is used to spin the second reel but not the first reel; after the re-spin, displaying the first set of symbols with the first reel and a third set of symbols with the second reel, wherein the third set of symbols is different from the second set of symbols; and after the re-spin, evaluating, with the processor, the first set of symbols and the third set of symbols relative to a pay line to determine whether the re-spin results in a predetermined game outcome.

In some embodiments, the present disclosure also relates to a computational device including: a user interface and a processor coupled with the user interface. The computational device is further disclosed to include a computer-readable storage medium, coupled with the processor, comprising instructions that are executable by the processor, wherein the instructions comprise: instructions that initiate a first reel spin in which a random number generator is used to determine a position of symbols within an array of symbol areas, wherein the array of symbol areas comprises a first row of symbol areas and a second row of symbol areas; instructions that present, via the user interface, the array of symbol areas with symbols positioned according to the first reel spin; instructions that, after the first reel spin, evaluate the position of symbols within the array of symbol areas to determine that a re-spin is available; instructions that determine that a symbol lock function will be implemented during the re-spin; instructions that identify the first row of symbol areas as a row of symbol areas that will remain locked during the re-spin; instructions that initiate the re-spin in which the random number generator is used to populate the second row of symbol areas with new symbols but maintain symbols in the first row of symbol areas according to the first reel spin; and instructions that, after the re-spin, evaluate symbols in the array of symbol areas relative to a pay line to determine whether the re-spin results in a predetermined game outcome.

In some embodiments, the present disclosure also relates to a system that includes: a processor; and a computer-readable storage medium, coupled with the processor, comprising instructions that are executable by the processor, wherein the instructions comprise: instructions that initiate a first reel spin in which a random number generator is used to determine a position of symbols within an array of symbol areas; instructions that present the array of symbol areas with symbols positioned according to the first reel spin; instructions that, after the first reel spin, evaluate the position of symbols within the array of symbol areas to determine that a re-spin is available; instructions that determine that a symbol lock function will be implemented during the re-spin; instructions that identify a plurality of adjacent symbol areas as a set of symbol areas that will remain locked during the re-spin; instructions that initiate the re-spin in which the random number generator is used to populate symbol areas other than the set of symbol areas with new symbols; and instructions that, after the re-spin, evaluate symbols in the array of symbol areas relative to a first pay line to determine whether the re-spin results in a predetermined game outcome.

Additional features and advantages are described herein and will be apparent from the following Description and the figures.

DETAILED DESCRIPTION

Figure 1A:
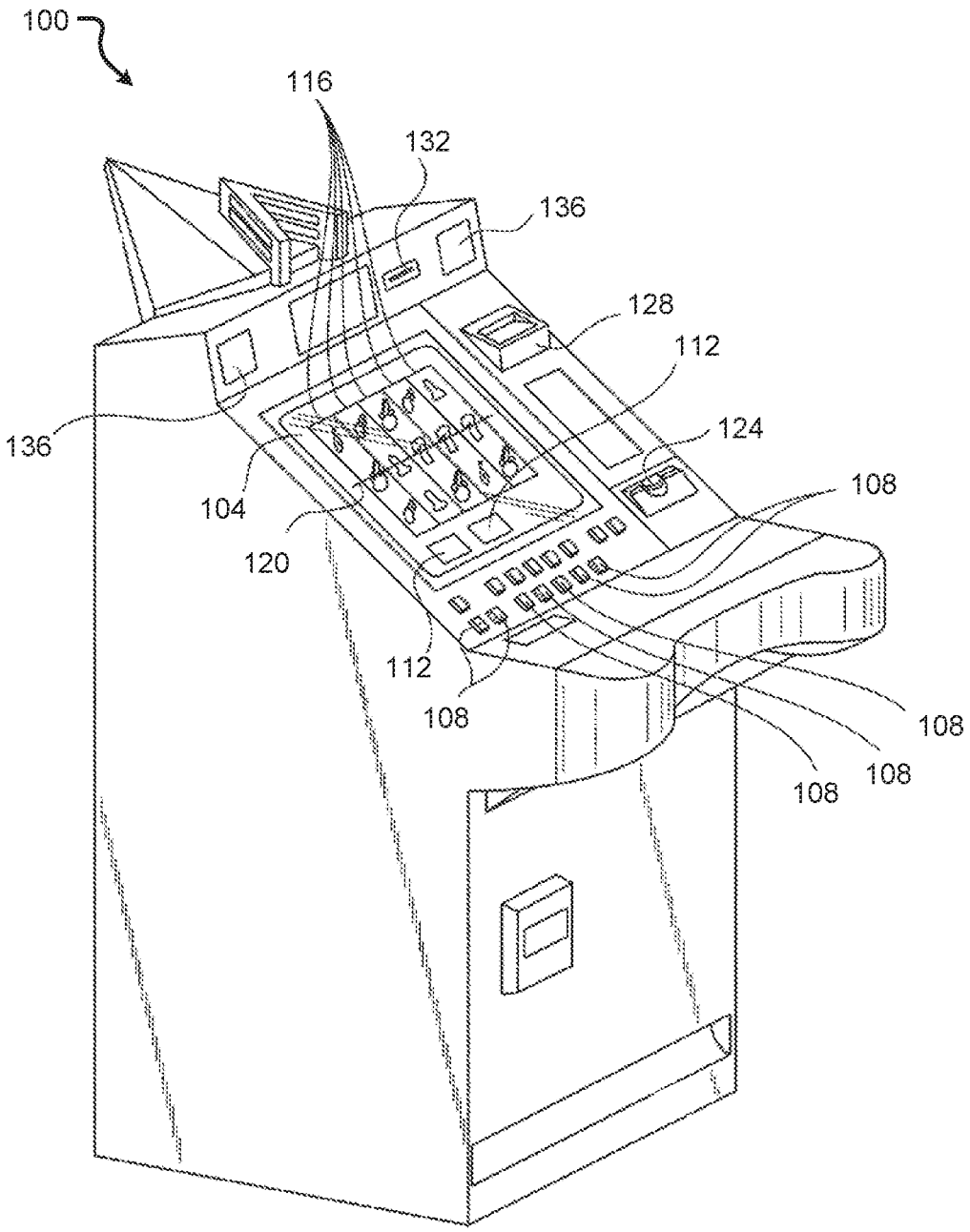
FIG. 1A depicts one example of a computational device in accordance with embodiments of the present disclosure.

Embodiments of the present disclosure will be described in connection with a computational device and, in particular, a computational device, such as a slot machine or Electronic Gaming Machine (EGM), that implements a symbol lock and re-spin operation. While embodiments of the present disclosure will be described in connection with the example of a slot machine or EGM implementing a symbol lock and re-spin operation, it should be appreciated that embodiments of the present disclosure are not so limited. For instance, other types of computational devices, such as portable user devices, smartphones, tablets, laptops, Personal Computers (PCs), wearable devices, etc. may be used to implement a symbol lock and re-spin operation as part of a game as described herein. Furthermore, it should be appreciated that embodiments of the present disclosure may apply to games other than slot games. For instance, embodiments of the present disclosure may be used in connection with any type of game such as bingo, keno, slots, video poker, table games, etc.

In some embodiments, a player is presented with the ability to play a special feature that allows them to lock an entire row or column and re-spin. During this one-time re-spin, the locked row or column does not change. Instead, the non-selected and non-locked rows or columns may have their symbols change during the re-spin. After the re-spin, the game play instructions can be configured to re-evaluate symbol positions for wins or other predetermined outcomes.

In one example, a symbol lock and re-spin operation in accordance with embodiments of the present disclosure may not allow for locking a row or column if that row or column includes a bonus symbols; otherwise, a player would potentially be allowed to get into bonus spins more than once if the lock feature becomes available with respect to a bonus symbol presented.

In one example, the ability to lock a row or column may only become available to a player after a predetermined betting threshold has been reached. Alternatively or additionally, the ability to lock a row or column may be based on a user's bet during the original spin (e.g., similar to a user selecting how many pay lines they want to play during a spin, the user could pre-select whether they want to have the ability for a re-spin with a locked row or column). It may also be possible to allow the user to change the number of pay lines they are playing during the re-spin with the locked row or column.

In some embodiments, the row or column that is locked during re-spin may be selectable by the user. In some instances, the user interface of a computing device may request additional inputs to accept a user selection of a row or column for locking. If implemented on a mobile device, then the selection of a row or column for locking may be substantially easier (e.g., with a swipe gesture across the desired row or column).

In one example, the game may re-compute gaming odds or wins based on the content of the locked row or column. In other examples, the game may apply the same spin logic and payouts for the re-spin as were applied during the original spin. This may be configurable by the customer (e.g., a casino operator or game administrator).

In one example, a symbol lock and re-spin feature could be implemented in a 5×5 slot machine, but any configuration and symbol array can benefit from this feature.

Furthermore, although embodiments of the present disclosure will be described in connection with implementing a symbol lock on a particular row or a particular column of a symbol array, it should be appreciated that embodiments of the present disclosure are not so limited. For instance, a set of symbols that are locked during a re-spin operation may correspond to any plurality of symbols in an array. The set of symbols that are locked may correspond to two or more symbols that are adjacent in any way and the adjacent symbols do not necessarily need to align with a single row or a single column. Rather, one or more adjacent symbols that are selected in the set of symbols for locking during re-spin may correspond to symbols that are diagonally-adjacent, meaning that symbols from different rows or different columns may be locked during a re-spin without departing from the scope of the present disclosure. The discussion and examples of rows or columns of symbols that are locked during a re-spin operation is for ease of discussion and should not be construed as limiting embodiments of the present disclosure.

Embodiments of the present disclosure also contemplate a game play scenario in which a user is awarded a bonus spin sequence or plurality of bonus spins in which the user is allowed to pick a certain number of symbols to lock for a predetermined number of the re-spin opportunities. The ability to select one, two, three, four, or more symbols to have a lock applied thereto may depend upon wagers placed by the user, an outcome of the original spin of the reels, or a combination thereof. In some embodiments, the user may be allowed to pick both the symbols that are locked and the number of re-spin opportunities to play (which may be limited to a predetermined maximum number). Thus, instead of a strict reel or row lock, embodiments of the present disclosure contemplate that a user may be allowed to pick N symbols (where N is an integer value that is great than or equal to one) to be locked for a predetermined or selected number of re-spin opportunities.

As mentioned above, this symbol lock and re-spin operation may be made available within the context of a slot game, a poker machine, or in any other game of chance that awards particular symbol combinations relative to positions on a user interface.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

Figure 1B:
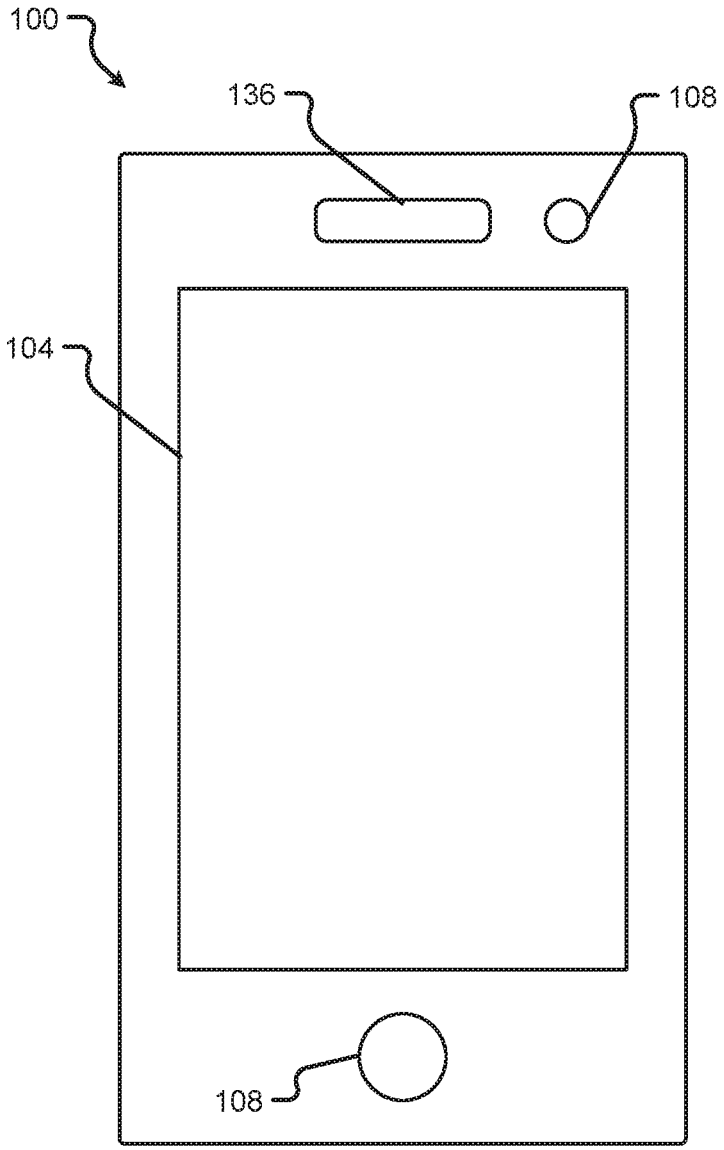
FIG. 1B depicts another example of a computational device in accordance with embodiments of the present disclosure.

With reference now to FIGS. 1A and 1B, an illustrative computational device 100 that may be used to implement a slot game or the like will be described in accordance with at least some embodiments of the present disclosure. A computational device 100 may include a portable or non-portable device used for executing a gaming application or multiple different gaming applications without departing from the scope of the present disclosure. Non-limiting examples of a computational device include a EGM, a Video Gaming Machine (VGM), a mobile communication device (e.g., a smartphone, laptop, wearable device, etc.), a laptop, a PC, etc. An EGM or VGM-type of computational device 100 is shown in FIG. 1A in accordance with embodiments of the present disclosure.

The illustrative computational device 100 of FIG. 1A is shown to include a support structure, housing or cabinet, which provides support for a plurality of displays, inputs, controls and other features of a conventional gaming machine. In the illustrated embodiment, a player plays computational device 100 while sitting, however, the computational device 100 is alternatively configured so that a player can operate it while standing or sitting. The illustrated computational device 100 is positioned on the floor but can be positioned alternatively (i) on a base or stand, (ii) as a pub-style table-top game (e.g., where the participant computational devices are located remotely from the shared wheel as discussed below), (iii) as a stand-alone computational device on the floor of a casino with other stand-alone computational devices, or (iv) in any other suitable manner. The computational device 100 can be constructed with varying cabinet and display configurations.

In one embodiment, a computational device 100 is configured to randomly generate awards and/or other game outcomes based on probability data. Since a computational device 100 generates outcomes randomly or based upon a probability calculation, there is no certainty that the computational device 100 will provide the player with any specific award or other game outcome.

In some embodiments, a computational device 100 may employ a predetermined or finite set or pool of awards, progressive awards, prizes or other game outcomes. As each award or other game outcome is provided to the player, the computational device 100 removes the provided award or other game outcome from the predetermined set or pool. Once removed from the set or pool, the specific provided award or other game outcome cannot be provided to the player again. The computational device 100 provides players with all of the available awards or other game outcomes over the course of the play cycle and guarantees a designated amount of actual wins and losses.

The computational device 100 may include one or more displays 112. An illustrative display 112 may include a credit display that displays a player's current number of credits, cash, account balance or the equivalent. Another illustrative display 112 may include a bet display that displays a player's amount wagered.

The computational device 100 is also shown to include at least one payment acceptor. Illustrative payment acceptors may include, without limitation, a coin slot 124, where the player inserts coins or tokens, and a ticket, note or bill acceptor 128, where the player inserts a bar-coded ticket, note, or cash. In one embodiment, a player-tracking card, credit card, debit card or data card reader/validator 132 is also provided for accepting any of those or other types of cards as a form of payment toward playing a game on the computational device 100.

In one embodiment, a player inserts an identification card into card reader 132 of computational device 100. The identification card can be a smart card having a programmed microchip or a magnetic strip coded with a player's identification, credit totals and other relevant information. In one embodiment, money may be transferred to computational device 100 through an electronic fund transfer and card reader 132 using the player's credit, debit or smart card. When a player funds computational device 100, a processor of the computational device 100 may determine the amount of funds entered and the corresponding amount is shown on the credit or other suitable display 112 as described above.

In one embodiment, after appropriate funding of computational device 100, the player presses a input device 108 to initiate game play. Input devices 108 may include various types of buttons, levers, gesture inputs, etc. that enable a player to start any game play or sequence of events. In one embodiment, upon appropriate funding, computational device 100 begins game play automatically. In another embodiment, the player needs to actuate or activate one of the play buttons to initiate play of computational device 100. Other non-limiting types of input devices 108 may include a bet one button, a max bet button, or any other type of button known to be included in an EGM, VGM, or the like. It should further be appreciated that the input devices 108 may correspond to a physical button, a virtual button on a touch-screen of a game, an input element on a Graphical User Interface (GUI),or a combination thereof. In other words, the input devices 108 do not need to correspond to a physical button. In some embodiments, the player places a bet by pushing a bet one button. The player may increase the player's wager by one credit each time the player pushes bet one button. When the player pushes the bet one button, the number of credits shown in the credit display decreases by one, and the number of credits shown in the bet display increases by one. A max bet max button can also be provided, which enables the player to bet the maximum wager (e.g., max lines, max wager per line, and re-spin operation). computational device 100 may include other suitable wager buttons, such as a repeat bet button, one or more select pay lines buttons, a select re-spin operation button, and one or more select wager per pay line buttons.

Another type of input device 108 that may be provided on the computational device 100 is a physical cash out button, a virtual cash out button, a selectable GUI element, or the like. The player presses a cash out button and cashes out to receive a cash payment or other suitable form of payment corresponding to the number of remaining credits. The player can receive coins or tokens in a coin payout tray or a ticket or credit slip, which are redeemable by a cashier or funded to the player's electronically-recordable identification card.

The computational device 100 may also include one or more display screens 104 and one or more sound generating devices 136. The combination of outputs provided on a display screen 104 and sound generating device 136 may contribute to the game play experience and, in some embodiments, may provide the player with information regarding a status of a game play event or sequence of events.

In one embodiment, the sound generating device 136 may include at least one speaker or other type of transducer for generating audible sounds, playing music, etc. In one embodiment, a computational device 100 provides dynamic sounds coupled with attractive multimedia images displayed on display screen 104 to provide an audio-visual representation or to otherwise display full-motion video with sound to attract players to computational device 100. During idle periods, the computational device 100 displays a sequence of audio and/or visual attraction messages to attract potential players to computational device 100.

In one embodiment, a base or primary game includes a slot game with one or more pay lines 120. As will be discussed in further detail herein, the game provided by the computational device 100 may support one or multiple pay lines 120, which may extend across the display screen 104 vertically, horizontally, diagonally, at adjusted angles, etc. In some embodiments, such as for a slot game, a pay line 120 intersects a plurality of reels 116, such as three to five reels. Each reel 116 of the display screen 104 may be used to display different sets of symbols in connection with game play activity provided by the computational device 100. In some embodiments, each reel 116 may operate independent of all other reels and the symbols displayed by a reel 116 at the end of a given spin may depend upon random numbers generated by the computational device 100.

The reels 116 may be provided as mechanical rotating reels, electromechanical rotating reels, and/or in video form with simulated reels being displayed via the display screen 104. A reel 116 may be used to display any number of symbols such as bells, hearts, fruits, numbers, letters, bars or other images, which preferably correspond to a theme associated with a game provided by the computational device 100. With a slot game, computational device 100 may be configured to award prizes, awards, or other game play opportunities when the reels 116 stop spinning and a predetermined symbol combination lands across an active pay line 120 (e.g., a pay line 120 that is currently being wagered and is subject to evaluation for a win after the reels 116 have stopped spinning).

FIG. 1B illustrates another example of a computational device 100 in accordance with at least some embodiments of the present disclosure. This particular example of computational device 100 may correspond to a portable computational device 100 such as a mobile smartphone, tablet, wearable, etc. The computational device 100 may be owned by a user of the device 100 rather than being owned by a casino operator.

The computational device 100 again includes a display screen 104, a plurality of input devices 108, and at least one speaker 136. In some embodiments, the display screen 104 may correspond to a touch-sensitive display screen, meaning that the display screen 104 is simultaneously capable of displaying information (e.g., in connection with game play activity) and receiving a user input. In some embodiments, the touch-sensitive display screen 104 may provide game features similar to a cabinet-style computational device 100 without requiring all of the dedicated buttons provided by a cabinet-style computational device 100.

Figure 2:
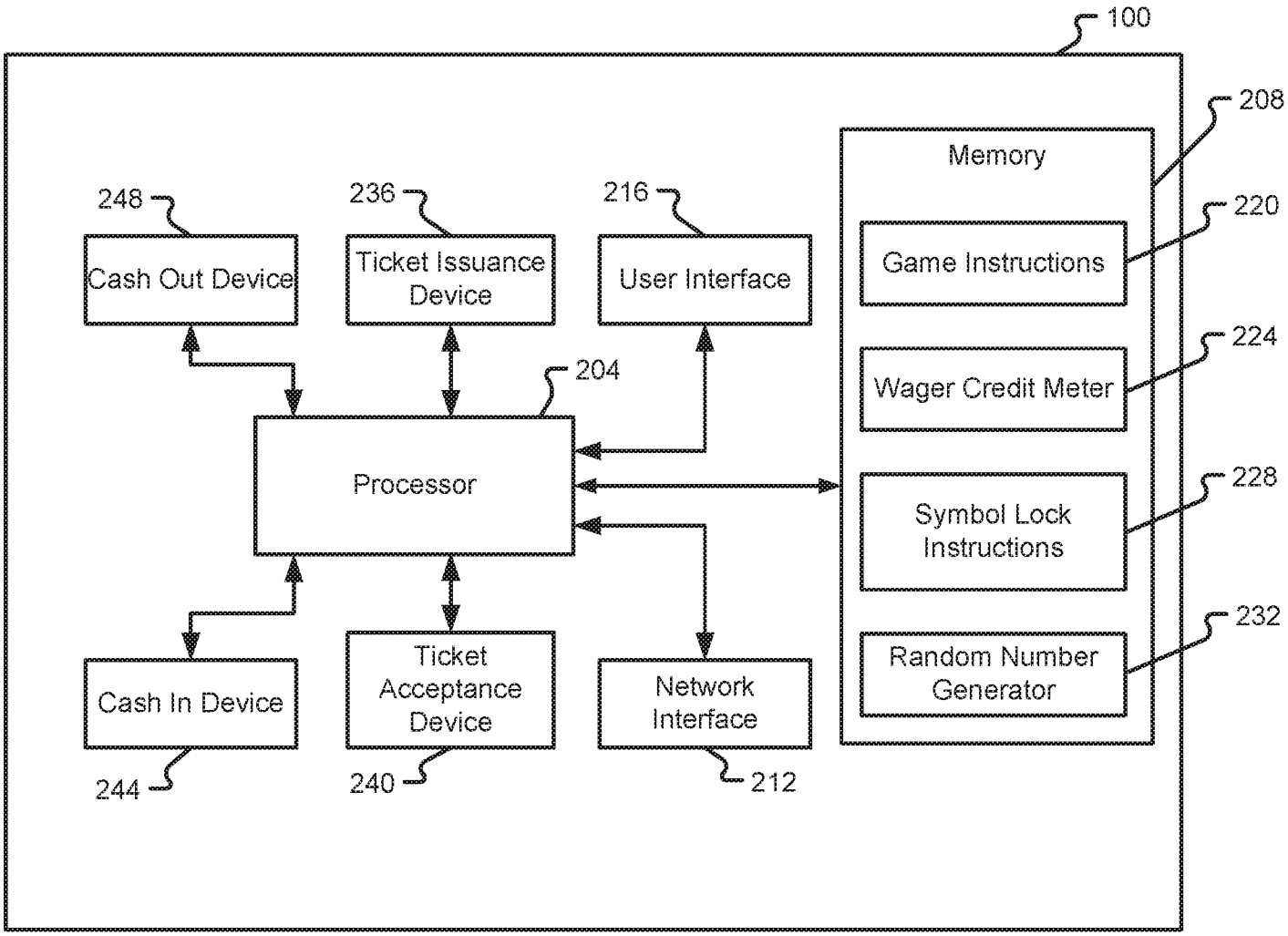
FIG. 2 is a block diagram depicting components of a computational device in accordance with embodiments of the present disclosure.

With reference now to FIG. 2, additional details of the components that may be included in a computational device 100 will be described in accordance with at least some embodiments of the present disclosure. The computational device 100 is shown to include a processor 204, memory 208, a network interface 212, and a user interface 216. In some embodiments, the processor 204 may correspond to one or many microprocessors, CPUs, microcontrollers, Integrated Circuit (IC) chips, or the like. The processor 204 may be configured to execute one or more instruction sets stored in memory 208. In some embodiments, the instruction sets stored in memory 208, when executed by the processor 204, may enable the computational device 100 to provide game play functionality.

The nature of the network interface 212 may depend upon whether the network interface 212 is provided in cabinet-style computational device 100 or a mobile computational device 100. Examples of a suitable network interface 212 include, without limitation, an Ethernet port, a USB port, an RS-232 port, an RS-485 port, a NIC, an antenna, a driver circuit, a modulator/demodulator, etc. The network interface 212 may include one or multiple different network interfaces depending upon whether the computational device 100 is connecting to a single communication network or multiple different types of communication networks. For instance, the computational device 100 may be provided with both a wired network interface 212 and a wireless network interface 212 without departing from the scope of the present disclosure.

The user interface 216 may include a combination of the user input and user outputs described in connection with FIGS. 1A and 1B. For instance, the user interface 216 may include the display screen 104, the input devices 108, the speakers 136, or any other component that is capable of enabling user interaction with the computational device 100. The user interface 216 may also include one or more drivers for the various hardware components that enable user interaction with the computational device 100.

The memory 208 may include one or multiple computer memory devices that are volatile or non-volatile. The memory 208 may be configured to store instruction sets that enable player interaction with the computational device 100 and that enable game play at the computational device 100. Examples of instruction sets that may be stored in the memory 208 include a game instruction set 220, a credit meter 224, and a symbol lock instruction set 228. In addition to the instruction sets, the memory 208 may also be configured to store a random number generator 232 that is used by the game instruction set 220, for example, to provide game outputs.

In some embodiments, the game instruction set 220, when executed by the processor 204, may enable the computational device 100 to facilitate one or more games of chance or skill and produce interactions between the player and the game of chance or skill. In some embodiments, the game instruction set 220 may include subroutines that present one or more graphics to the player via the user interface 216, subroutines that calculate whether a particular wager has resulted in a win or loss during the game of chance or skill, subroutines for determining payouts for the player in the event of a win, subroutines for exchanging communications with another device, such as a server, subroutines for determining re-spin opportunities during game play, and any other subroutine useful in connection with facilitating game play at the computational device 100.

In some embodiments, the game instruction set 220 may include instructions that initiate a reel spin at the various reels 116 in connection with game play. In some embodiments, the random number generator 232 is used to determine a final position of the reels 116 after the spin is completed. The game instruction set 220 may also be configured to present symbols via the display screen 104 when the reels 116 correspond to video reels or the like. The game instruction set 220 may also be configured to evaluate a position of symbols relative to one or more pay lines 120, relative to predetermined symbol areas, and any other evaluation desired to facilitate game play.

The credit meter 224 may correspond to an instruction set within the computational device 100 that facilitates a tracking of wager activity at the computational device 100. In some embodiments, the credit meter 224 may be used to store or log information related to various player activities and events that occur at the computational device 100. The types of information that may be maintained in the credit meter 224 include, without limitation, player information, available credit information, wager amount information, and other types of information that may or may not need to be recorded for purposes of accounting for wagers placed at the computational device 100 and payouts made for a player during a game of chance or skill played at the computational device 100.

In some embodiments, the credit meter 224 may be configured to track coin in activity, coin out activity, coin drop activity, jackpot paid activity, credits applied activity, external bonus payout activity, voucher in activity, voucher out activity, timing of events that occur at the computational device 100, and the like. In some embodiments, certain portions of the credit meter 224 may be updated in response to outcomes of a game of chance or skill played at the computational device 100.

The symbol lock instruction set 228 may correspond to a subroutine that is called by the game instruction set 220 during game play. In some embodiments, the symbol lock instruction set 228 may be called by the game instruction set 220 when the game instruction set determines that a re-spin operation is available and/or that a symbol lock feature is allowable during the re-spin operation. In some embodiments, the symbol lock instruction set 228 is configured, when executed by the processor 204, to prompt a player for a selection of symbols (e.g., a row of symbols, a column of symbols, or some other set of symbols having an adjacent relationship with one another) to be locked during a re-spin operation. The symbol lock instruction set 228 may further receive the user input that indicates the desired set of symbols to lock during the re-spin and then the symbol lock instruction set 228 may inform the game instruction set 220 of the symbols to lock during the re-spin operation. The game instruction set 220 can then implement a re-spin operation while locking the set of symbols identified by the symbol lock instruction set 228. In some embodiments, the symbol lock instruction set 228 may also be configured to identify which symbols are eligible for locking during the re-spin or, conversely, are ineligible from being locked during the re-spin. In some embodiments, the symbol lock instruction set 228 may identify a row or column having a bonus symbol therein as an ineligible row or column for locking during the re-spin. Alternatively or additionally, the symbol lock instruction set 228 may identify a row or column that entirely traverses a pay line 120 as an ineligible row or column for locking during the re-spin. It is the cooperation of the game instruction set 220 and symbol lock instruction set 228 that helps increase the desirability of the overall gaming experience and that gives a player the sense of control over the game that may increase their desire to continue playing the game instruction set 220.

While shown as separate instruction sets, it should be appreciated that the symbol lock instruction set 228 may correspond to a subroutine of the game instruction set 220 without departing from the scope of the present disclosure. Additional details and functional capabilities of the symbol lock instruction set 228 working in cooperation with the game instruction set 220 will be described in connection with FIGS. 3-5E.

The computational device 100 is further shown to include a ticket issuance device 236, a ticket acceptance device 240, a cash in device 244, and a cash out device 238. The ticket issuance device 236 may be configured to receive physical tickets, vouchers, or player loyalty cards. In some embodiments, the ticket issuance device 236 and ticket acceptance device 240 may operate in concert with the ticket acceptor 128. In such an embodiment, the ticket acceptor 128 may correspond to the physical components that receive and issue a ticket or voucher whereas the ticket acceptance device 240 and ticket issuance device 236 correspond to the drivers and/or firmware components that control operation of the ticket acceptor 128. It should also be appreciated that the card reader 132 may be in communication with the ticket issuance device 236 and ticket acceptance device 140 and may have functionality driven by one or both of these devices. For instance, the card reader 132 may correspond to the physical hardware components that receive information from a player loyalty card (or player loyalty application on a mobile communication device) and that information may be processed by the ticket acceptance device 240 when receiving player credits from cards read by the card reader 132. The ticket issuance device 236 may provide the card reader 132 with information for applying wager credits back to a player card when a player is done with a game play session and wishes to transfer credits from the credit meter 224 back onto their card. Thus, the ticket issuance device 236 and ticket acceptance device 240 may also operate as a driver and/or firmware component for the card reader 132.

Similarly, the cash in device 244 and cash out device 248 may include or operate in concert with the coin slot 124 and any coin delivery mechanisms. The cash in device 244 and cash out device 248 may include hardware, drivers, or firmware that facilitate receiving or distributing cash, tokens, bills, etc. In some embodiments, the cash in device 244 may be configured to determine an amount of cash (e.g., in coins, bills, etc.), an amount of tokens, etc., input at the coin slot 124 and convert the values into credits for playing games with the game instruction set 220. The cash out device 248 may correspond to hardware and software configured to output coins, tokens, bills, etc. if a player decides to cash out or convert playing credits back into cash, tokens, bills, etc.

Figure 3:
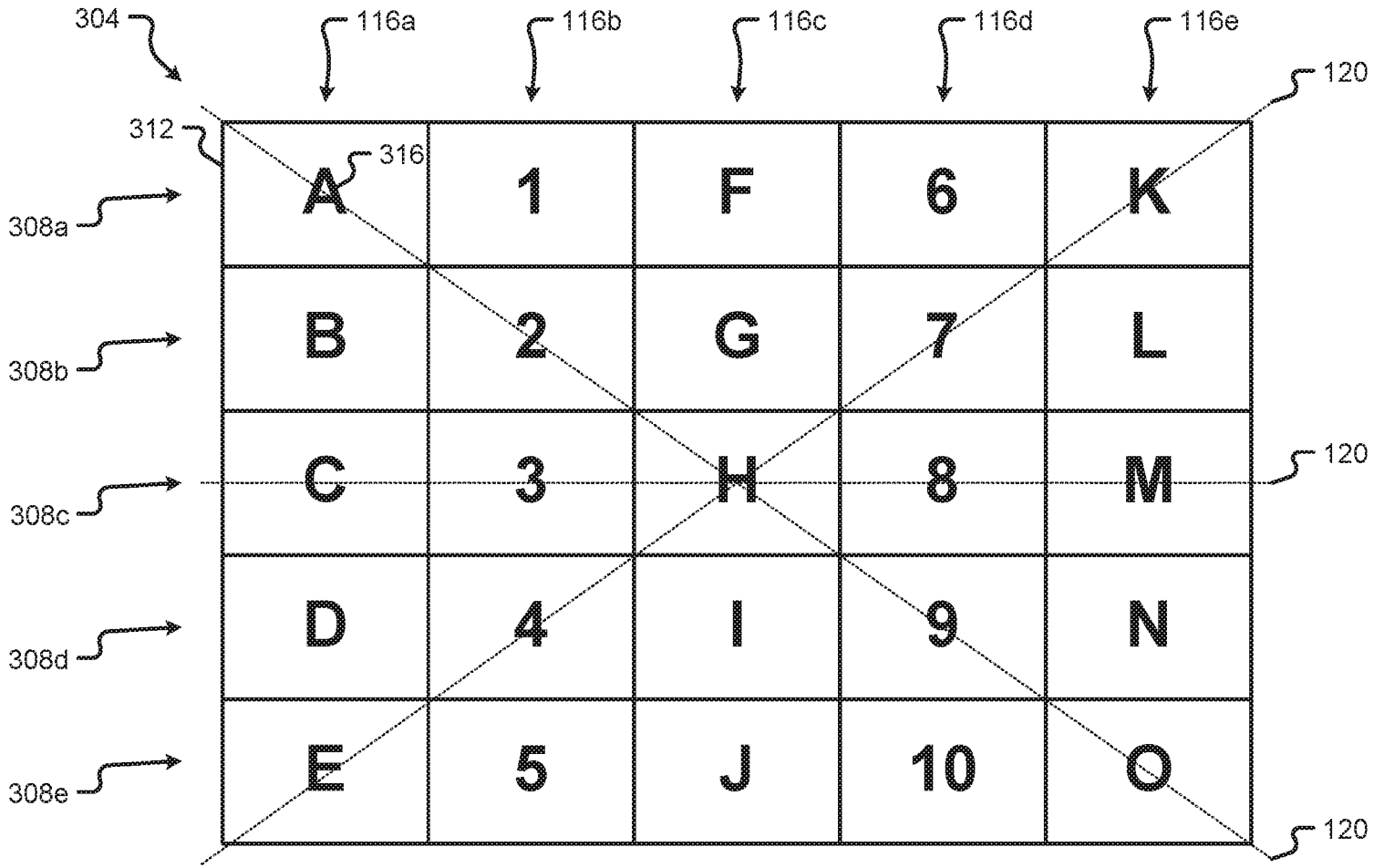
FIG. 3 is an illustrative layout of symbols within an array of symbol areas in accordance with embodiments of the present disclosure.

With reference now to FIGS. 3 to 5E, various operations of the game instruction set 220 and symbol lock instruction set 228 will be described in accordance with at least some embodiments of the present disclosure. Referring initially to FIG. 3, a first layout of an array of symbol areas 304 will be described in accordance with embodiments of the present disclosure. The array of symbol areas 304 may be presented with the display screen 104. In some embodiments, the game instruction set 220 may control which particular symbols 316 are presented within a particular symbol area 312. The illustrative array of symbol areas 304 is shown to include five columns 116*a*, 116*b*, 116*c*, 116*d*, 116*e* of symbol areas 312 and five rows 308*a*, 308*b*, 308*c*, 308*d*, 308*e* of symbol areas 312. Although FIG. 3 illustrates a 5×5 array of symbol areas 304, it should be appreciated that embodiments of the present disclosure can be implemented in an array of symbol areas 304 having a variety of sizes. For instance, embodiments of the present disclosure may be used in an array of symbol areas 304 that are 3×3, 3×5, 5×3, 7×3, 10×5, 10×10, etc. The example layout of the array of symbol areas 304 should not be construed as limiting embodiments of the present disclosure.

As can be seen in FIG. 3, each symbol area 312 in the array of symbol areas 304 may be populated with a single symbol 316. In other words, after the game instruction set 220 has applied a random number generator 232 to determine symbol 316 placement throughout the array of symbol areas 304, there will be a 1:1 correlation of symbols 316 to symbol areas 312. Each column 116*a*, 116*b*, 116*c*, 116*d*, 116*e* may also be referred to as a reel 116, particularly in the event that the game instruction set 220 provides a slot game. If a slot game is implemented, then the reels 116 (mechanical or video) are spun (physically or virtually) and their final position after the spin is determined, at least in part, with assistance of the random number generator 232.

In some embodiments, payouts or other predetermined game outcomes (e.g., bonus spin opportunities, prize wins, cash wins, re-spin bonus play, etc.) may be determined based on a symbol combination that falls on a pay line 120 that was subject to a wager prior to the spin. In some embodiments, a plurality of the pay lines 120 may be selected for "play" prior to a spin, meaning that any pay line 120 selected for "play" will be evaluated for a predetermined symbol combination. A selected pay line 120 may also correspond to the pay line 120 that is evaluated after symbols 316 have been subjected to a symbol lock and re-spin operation by the symbol lock instruction set 228. In some embodiments, however, it may be possible to switch or select more pay lines 120 for evaluation after a spin has completed, but before a re-spin operation has been performed. The addition of more pay lines 120 after the original spin but prior to the re-spin may require the user to provide more credits to the game instruction set 220 as part of enabling evaluation over more pay lines 120.

Figure 4A:
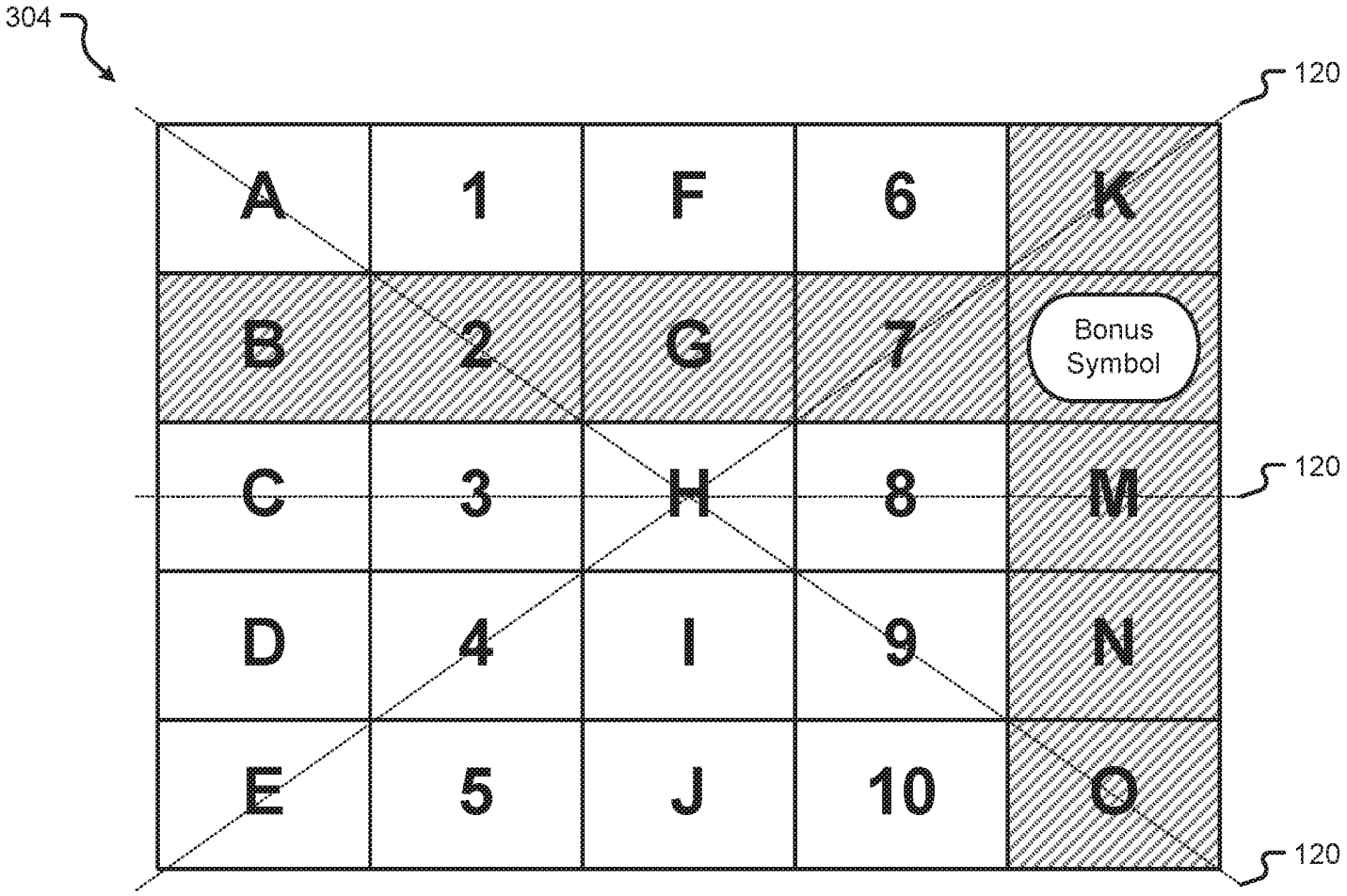
FIG. 4A illustrates a first device output during a first game play sequence in accordance with embodiments of the present disclosure.
Figure 4B:
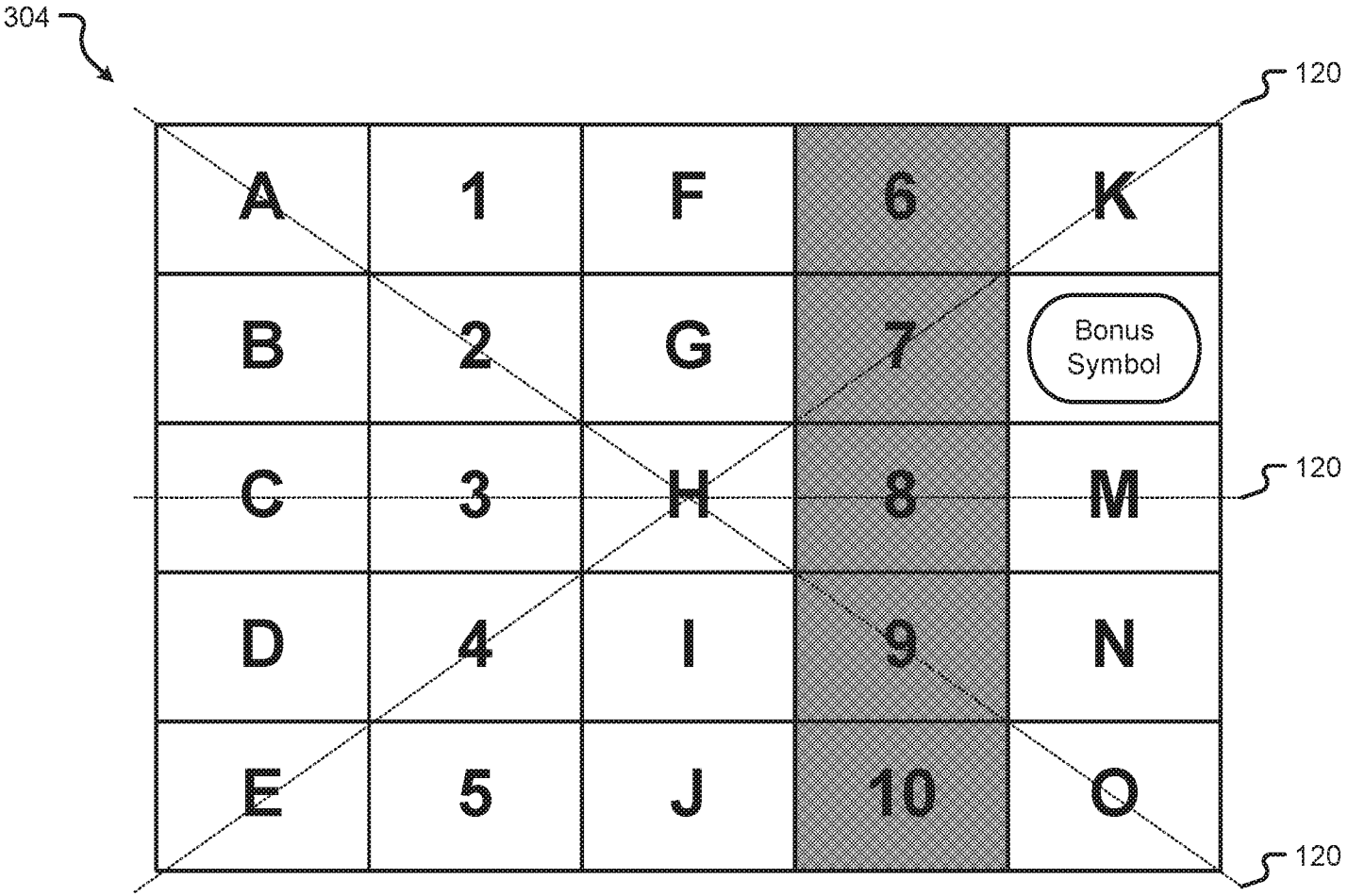
FIG. 4B illustrates a second device output during the first game play sequence in accordance with embodiments of the present disclosure.
Figure 4C:
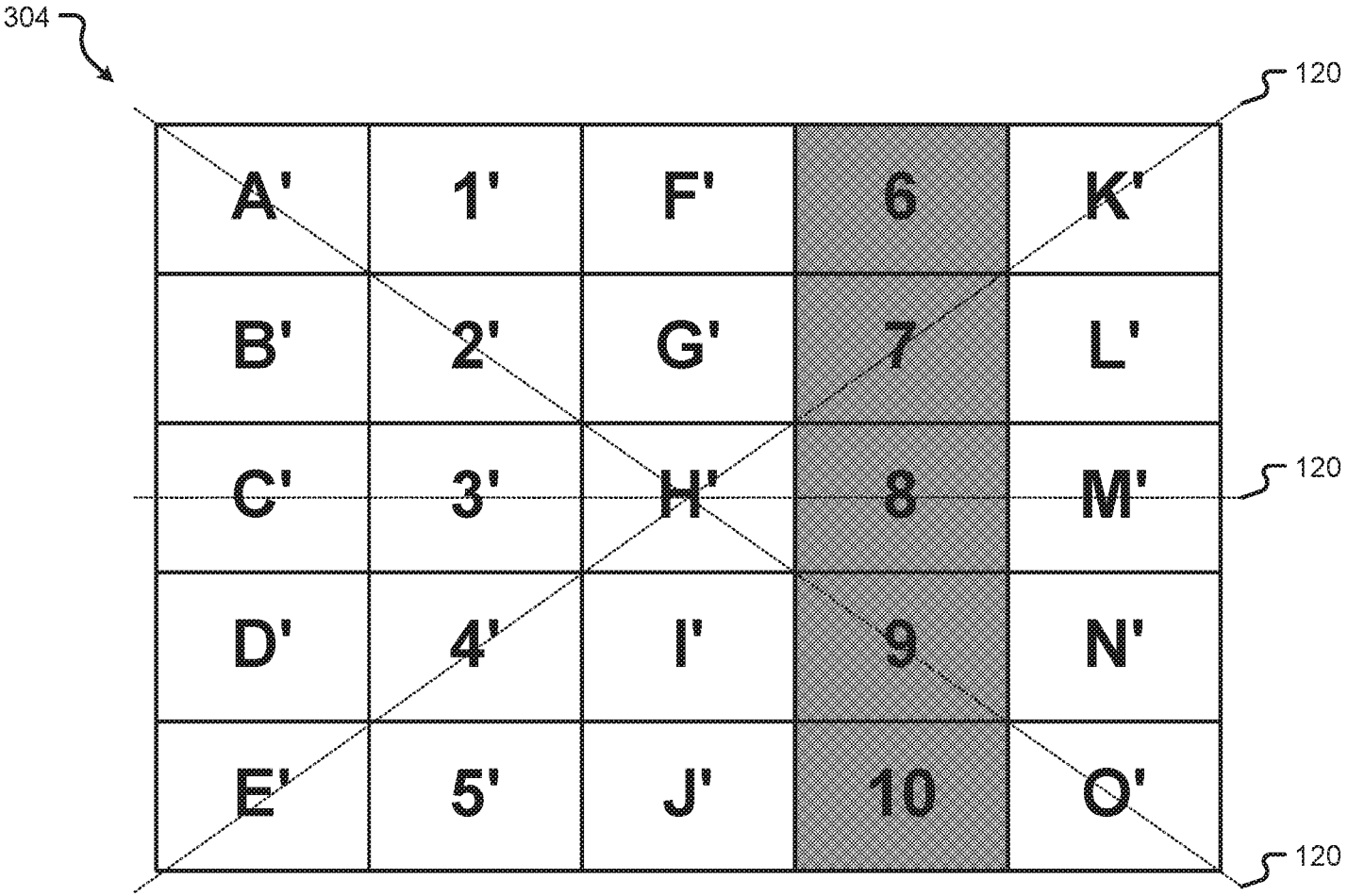
FIG. 4C illustrates a third device output during the first game play sequence in accordance with embodiments of the present disclosure.

Referring now to FIGS. 4A thru 4C, a first illustrative game play sequence that can be performed by the game instruction set 220 and symbol lock instruction set 228 will be described in accordance with at least some embodiments of the present disclosure. In the example of FIG. 4A, a bonus symbol is shown to have landed in a symbol area 312. Specifically, the bonus symbol is shown to have landed in the symbol area 312 that resides at the intersection of the second row 308*b* and the fifth column 116*e*. The original spin and placement of symbols 316 throughout the array of symbol areas 304 may have been determined by the game instruction set 220 working in cooperation with the random number generator 232. The position of symbols 316 in the array of symbol areas 304 may be evaluated by the game instruction set 220 to determine if a predetermined game outcome has occurred (e.g., a wager has resulted in a win or prize, a re-spin is available, etc.). If the game instruction set 220 determines that a re-spin is available, then the symbol lock instruction set 228 may analyze the array of symbol areas 304 to search for the bonus symbol.

In this particular example, the symbol lock instruction set 228 may identify the fifth column 116*e* and the second row 308*b* as ineligible for a symbol lock. However, the other columns (e.g., columns 116*a*, 116*b*, 116*c*, 116*d*) and the other rows (e.g., rows 308*a*, 308*c*, 308*d*, 308*e*) may be identified by the symbol lock instruction set 228 as eligible for locking during a re-spin operation. This information may be conveyed to a player of the game by highlighting the rows/columns that are eligible for a symbol lock, highlighting the rows/columns that are ineligible for a symbol, and/or by providing the player with a pop-up window indicating that one or more symbols 316 (e.g., symbols 316 residing in a row 308, column 116, or other set of adjacent symbol areas 312) are available for the symbol lock.

As shown in FIG. 4B, the player may be allowed to select a particular set of symbols 316 for the symbol lock during re-spin. In the example of FIG. 4B, the fourth column 116*d* has been selected by the player for the symbol lock during the re-spin.

FIG. 4C illustrates the array of symbol areas 304 after the re-spin in which the symbols 316 residing in the fourth column 116*d* were held in a locked state. Specifically, each of the other columns 116*a*, 116*b*, 116*c*, 116*e* were subjected to the re-spin operation. In some embodiments, the re-spin may be implemented by the game instruction set 220 and the position of symbols 116 within the columns subjected to the re-spin may be determined, at least in part, by an output of the random number generator 232.

Figure 5A:
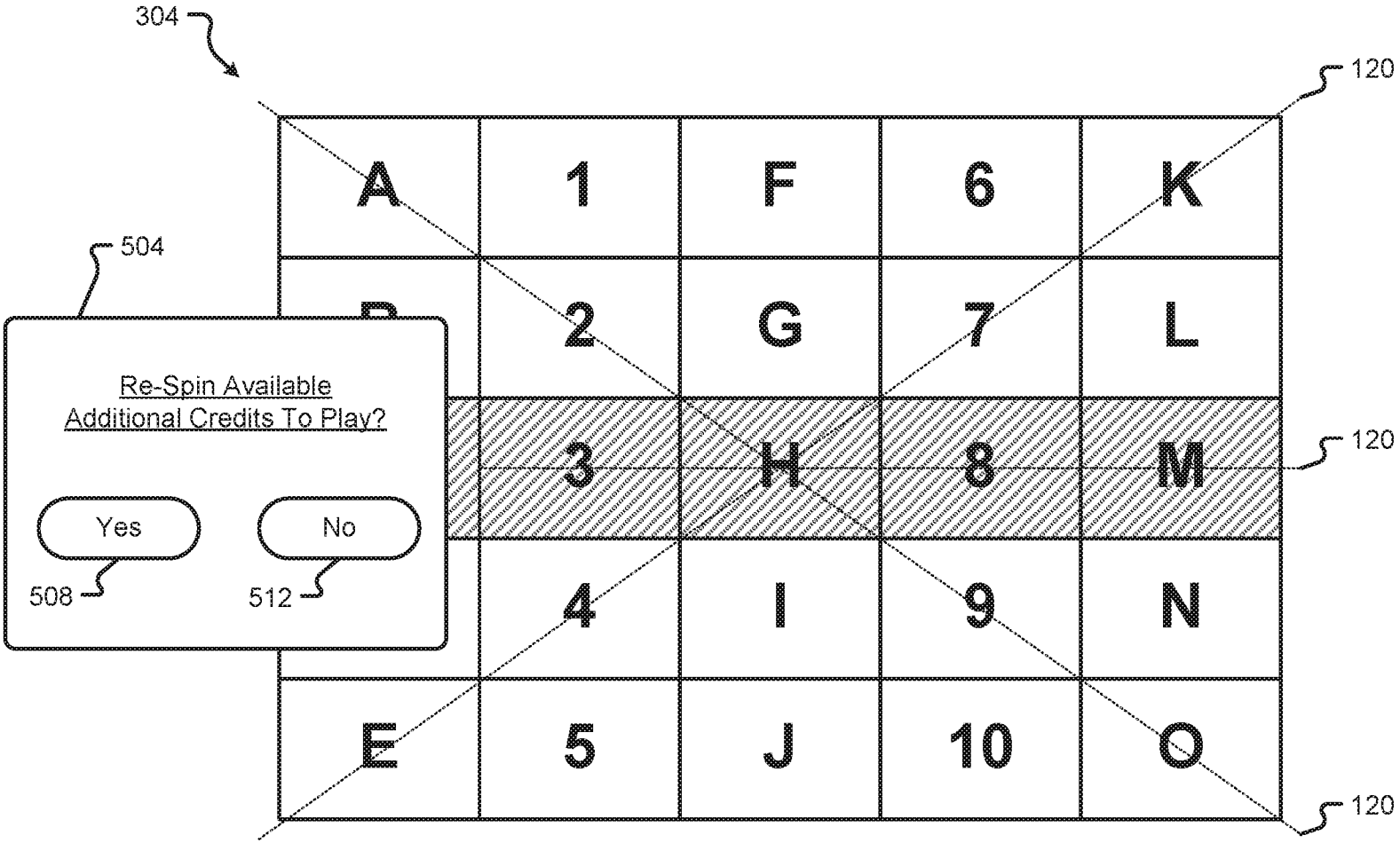
FIG. 5A illustrates a pop-up window with a user prompt in accordance with embodiments of the present disclosure.

Referring now to FIGS. 5A thru 5E, another game play sequence will be described in accordance with at least some embodiments of the present disclosure. FIG. 5A illustrates a pop-up window 504 that may be presented to a player in response to the game instruction set 220 determining that a re-spin opportunity is available for the player. The pop-up window 504 may include a yes icon 508 and no icon 512 that are user-selectable icons. As can be appreciated, that desire of a player to initiate a re-spin may be determined based on the player's response to the pop-up window 504. More specifically, if the player selects the yes icon 508, then the game instruction set 220 may call the symbol lock instruction set 228 whereas if the player selects the no icon 512, then the game instruction set 220 may continue operating without calling the symbol lock instruction set 228.

Figure 5B:
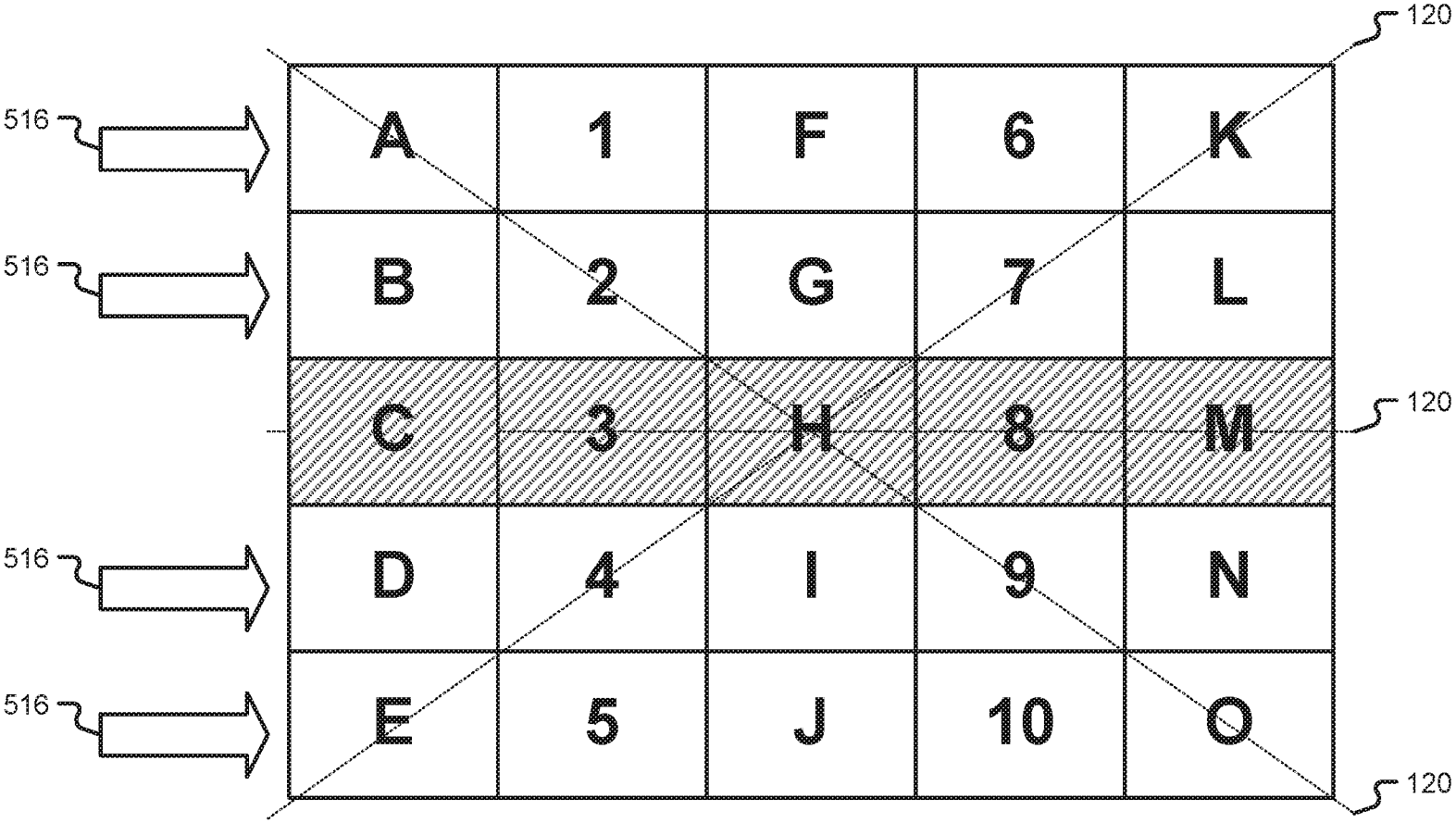
FIG. 5B illustrates user selection options in accordance with embodiments of the present disclosure.

FIGS. 5A and 5B also illustrate the symbol lock instruction set's 228 ability to highlight a row or column that is ineligible for locking during the re-spin operation. In some embodiments, the ineligible row may correspond to a row that is aligned with a pay line 120 already selected by a player for evaluation. As shown in FIG. 5B, however, the symbol lock instruction set 228 may provide one or more selectable user inputs 516 that allow a player to select another row 308 that is eligible for having symbols 316 presented therein become locked during the re-spin.

Figure 5C:
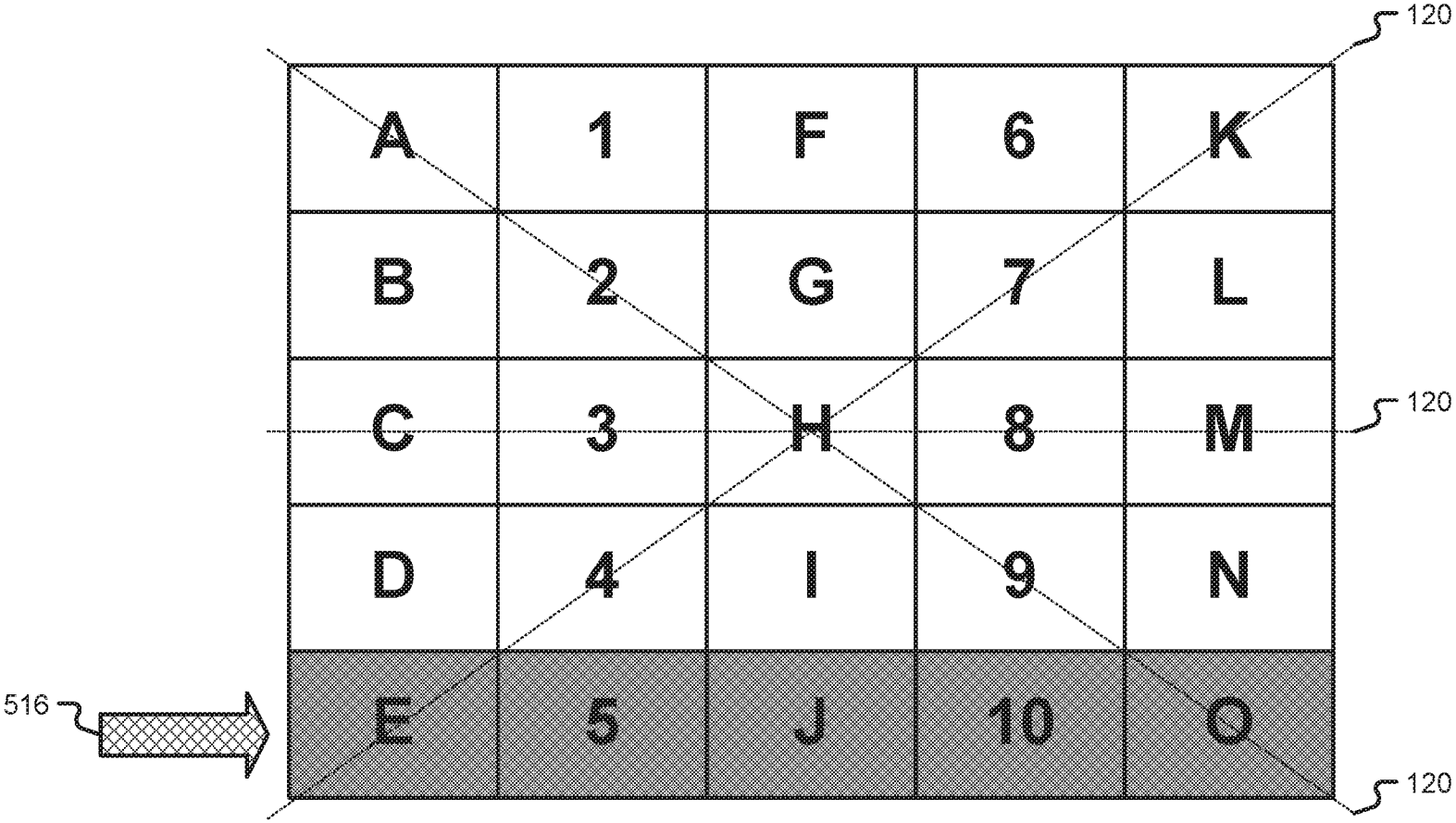
FIG. 5C illustrates a user-selected set of symbols in accordance with embodiments of the present disclosure.

FIG. 5C illustrates an example where the player selects the fifth row 308*e* for locking during the re-spin operation. In some embodiments, the symbol-lock instruction set 228 may cause the selected row 308*e* to be highlighted as an indication to the player that the selection of a row lock has been received and will be implemented during the re-spin.

Figure 5D:
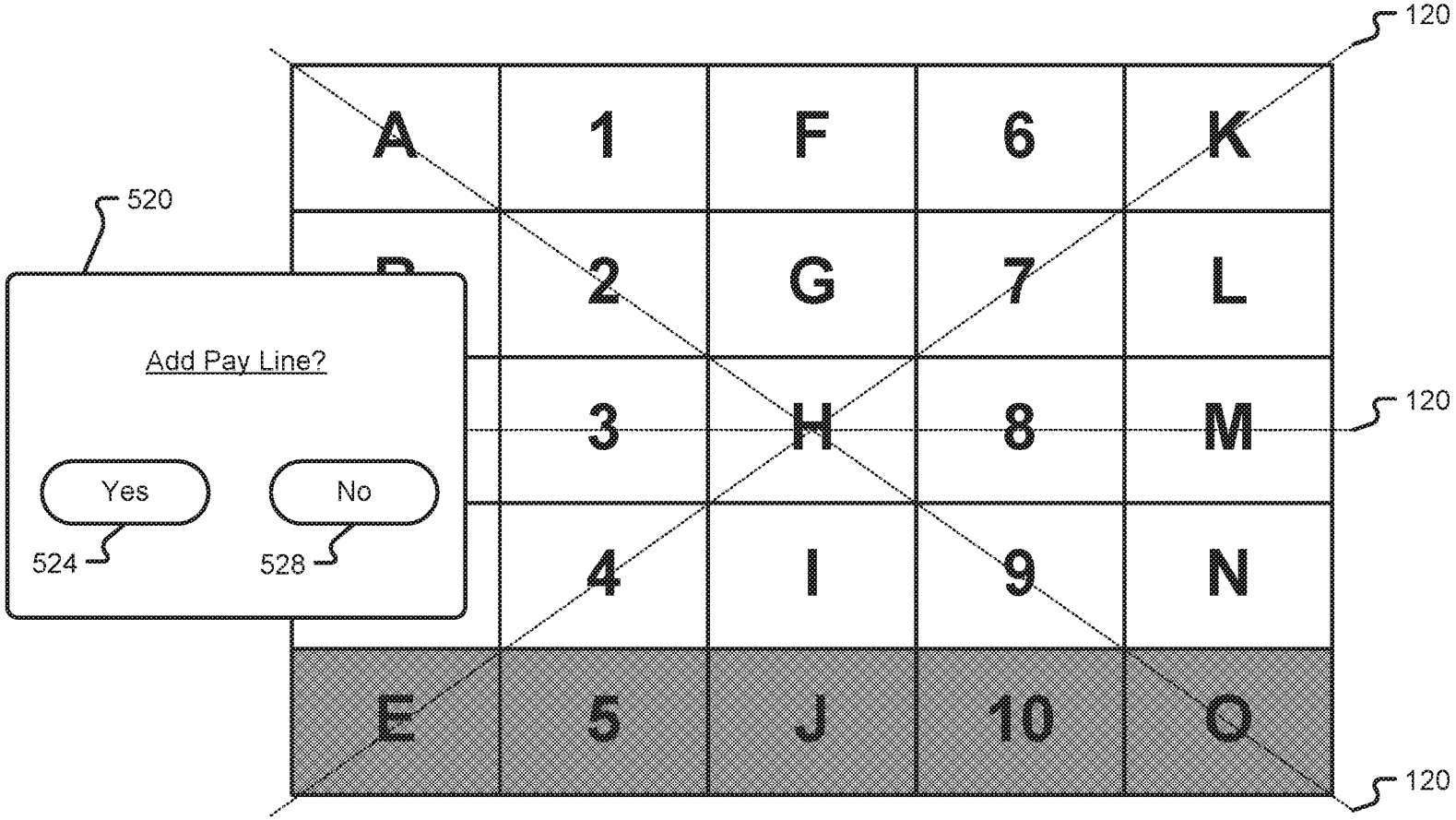
FIG. 5D illustrates a second pop-up window with a user prompt in accordance with embodiments of the present disclosure.

FIG. 5D illustrates an additional pop-up window 520 that can be presented to the player, possibly after the desired row has been selected for a symbol lock. The additional pop-up window 520 may include a prompt asking the player whether or not an additional pay line 120 is desired for evaluation after the re-spin. Much like the pop-up window 504, the additional pop-up window 520 may include a yes icon 524 and a no icon 528. The player's selection of a yes icon 524 may allow the player to select another pay line 120 for evaluation after the re-spin. As can be appreciated, the selection of another pay line 120 may require the player to provide additional game credits prior to the game instruction set 220 completing the re-spin. The player's selection of the no icon 528 may enable the re-spin to continue and the game instruction set 220 will evaluate the same pay lines 120 as were evaluated following the original spin.

Figure 5E:
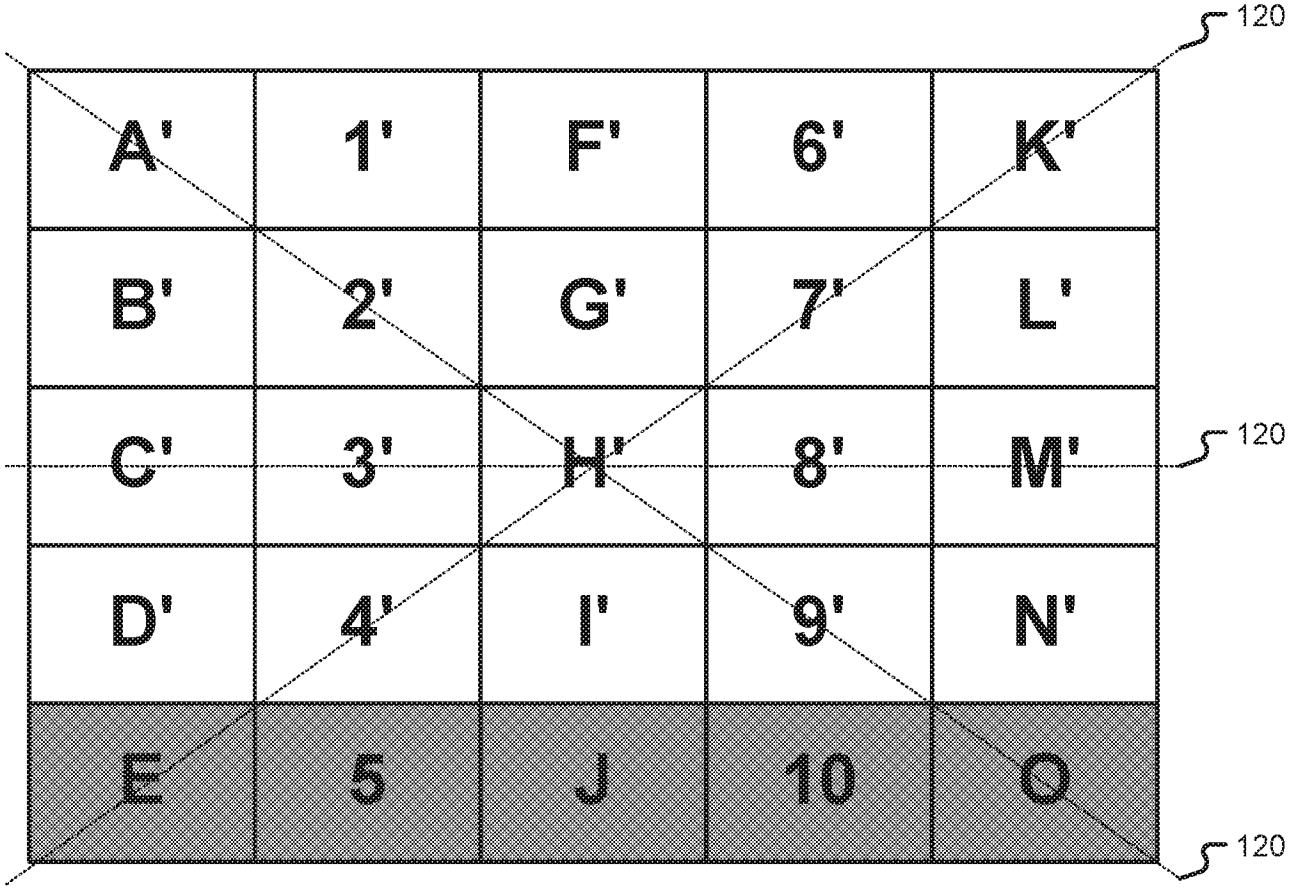
FIG. 5E illustrates an array of symbols after a re-spin with locked symbols in accordance with embodiments of the present disclosure.

FIG. 5E illustrates the array of symbol areas 304 after the re-spin operation has concluded. As can be seen in FIG. 5E, the row 308*e* selected by the player to be a locked row may retain the same symbols after the re-spin whereas the other symbol areas 312 may have new symbols 316 provided therein. The symbols 316 that populate the symbol areas 312 not subject to the symbol lock function may be determined, at least in part, based on an output of the random number generator 232.

Figure 6:
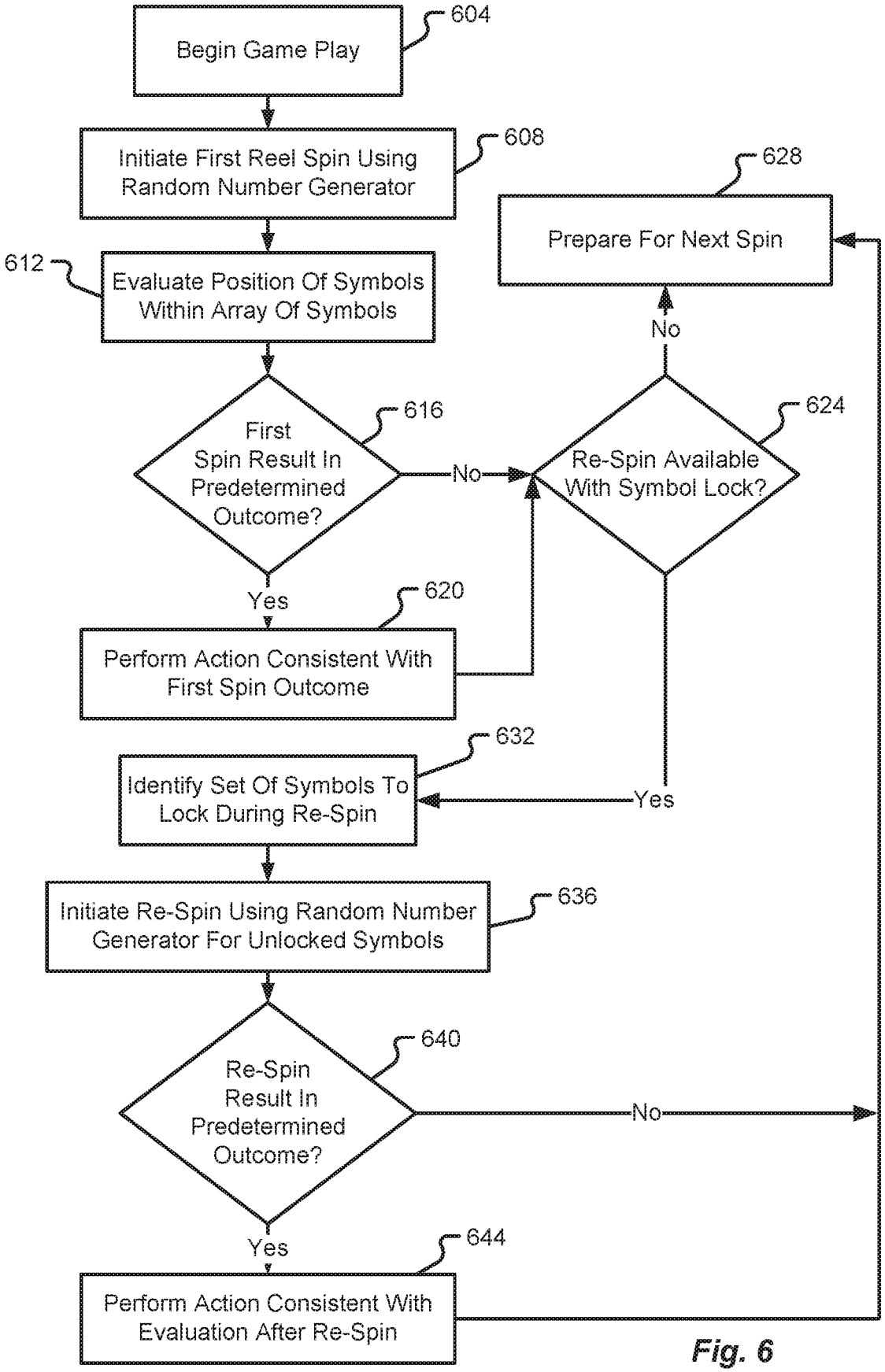
FIG. 6 is a flow chart illustrating a game play method with a symbol lock operation in accordance with embodiments of the present disclosure.

With reference now to FIG. 6, a game play method with a possibility of a symbol lock and re-spin operation will be described in accordance with at least some embodiments of the present disclosure. The method begins when game play is initiated by a player of the computational device 100 (step 604). This step may occur in response to the player selecting a predetermined button 108, inserting coins, cash, tickets, vouchers, etc., or performing some other action at the computational device 100 that indicates a desire to begin game play.

The method may continue by the game instruction set 220 initiating a first reel spin that leverages the random number generator 232 to determine a final position of symbols (step 608). After the first reel spin is completed, the game instruction set 220 may evaluate symbols 316 laid out in the array of symbols 304 (step 612). The evaluation of symbols 316 may include determining which pay lines 120 will be subject to evaluation and whether any of the selected pay lines 120 have a predetermined combination of symbols 316 provided thereon. Eventually, the game instruction set 220 will evaluate the symbols 316 that land on a selected pay line 120 or a plurality of selected pay lines 120 to determine if the first spin resulted in a predetermined game outcome (step 616). The predetermined game outcome may include winning a prize, winning playing credit, winning money, winning a bonus spin, achieving a game achievement, etc.

Thereafter, the game instruction set 220 will cause the computational device 100 to perform an action consistent with the first spin outcome (step 620), if the first spin resulted in a predetermined game outcome. The game instruction set 220 will also determine whether a re-spin with a symbol lock opportunity is available for the player (step 624). The order of operations, evaluation, and analysis may be important as part of maintaining a primary pay table and odds that conform with gaming regulations. If the analysis for a re-spin opportunity occurs prior to the evaluation of the first spin results, then the game odds may change or other system requirements may need to be considered.

If the query of step 624 is answered negatively, then the game play ends and the computational device 100 prepares for the next spin (step 628). If the query of step 624 is answered positively, then the method continues with the game instruction set 220 calling the symbol lock instruction set 228 to identify a set of symbols within the array of symbol areas 304 that will be subjected to a lock operation during a re-spin (step 623). In some embodiments, the identification of the set of symbols may be performed automatically based on a particular symbol 316 landing within a particular symbol area 312. In some embodiments, the identification of the set of symbols to be locked during the re-spin may be based on determining which symbols 316 or symbol areas 312 are not eligible for locking during the re-spin. Moreover, the identification of the set of symbols may depend, at least in part, on an input received from the player (e.g., a player selection or a player indication of a desire to lock a set of symbols during the re-spin). As can be appreciated, the opportunity to select a set of symbols for locking during the re-spin may be selected by the player and does not necessarily need to correspond to a row or column, but rather can correspond to a set of symbols that are selected by the player. It may also be possible to modify the number of symbols that the player is allowed to select based on wagers or credits played by the player.

Thereafter, the symbol lock instruction set 228 will lock the identified symbols 316 and indicate to the game instruction set 220 that the array of symbols 304 (with the exception of the locked symbols) is ready for re-spin. In response, the game instruction set 220 may initiate the re-spin using the random number generator 232 to determine new symbols 316 for the unlocked symbol areas 312 (step 636).

Thereafter, the game instruction set 220 evaluates the re-spin of the symbols 316 with respect to one or more selected pay lines 120 to determine if the re-spin has resulted in another (and perhaps different) predetermined outcome (step 640). If this query is answered negatively, then the method proceeds to step 628. If this query is answered positively, then the method proceeds with the game instruction set 220 enabling the computational device 100 to perform an action consistent with the evaluation of symbols 316 after the symbol lock and re-spin operation (step 644). Thereafter, the method proceeds to step 1128.

Figure 7:
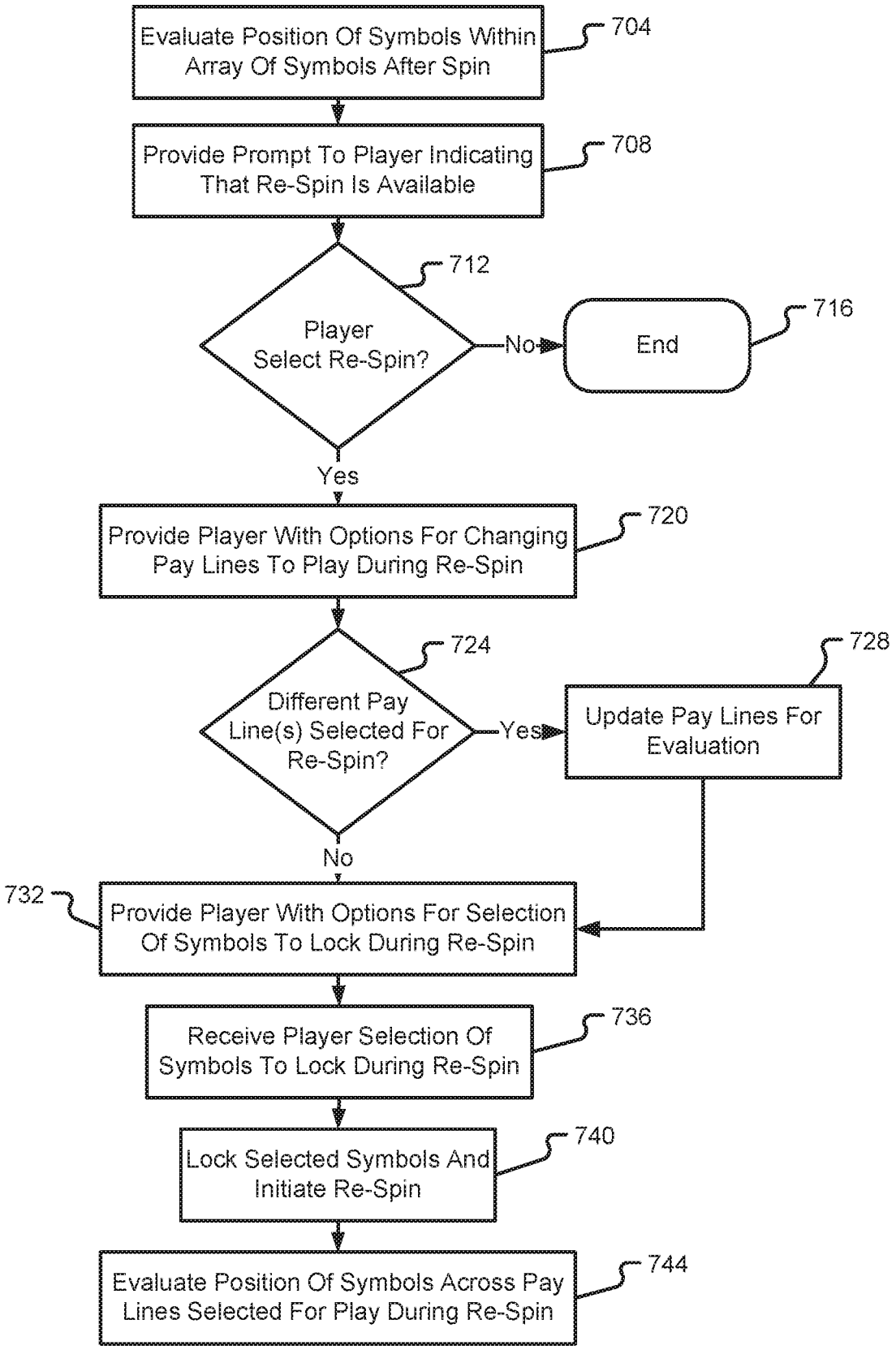
FIG. 7 is a flow chart illustrating details of interacting with a player during a game play method in accordance with embodiments of the present disclosure.

With reference now to FIG. 7, another method of enabling player interactions during a game play will be described in accordance with embodiments of the present disclosure. The method begins with the game instruction set 220 evaluating a position of symbols 316 within the array of symbol areas 304 after a first spin (step 704). The method then continues with the game instruction set 220 providing a prompt to the player that indicates a re-spin opportunity is available (step 708). In some embodiments, the prompt may be provided as narrative text within a pop-up window 504. In some embodiments, the prompt may be provided by highlighting row and/or columns in the array of symbol areas 304 that are eligible (or ineligible) to be locked during the re-spin. In some embodiments, the prompt may be provided by highlighting a re-spin indicator or other purpose-built user input or output device that is part of the computational device 100 (e.g., lighting a light, sounding a buzzer, etc.).

The method continues by determining whether or not the player has elected to play the re-spin opportunity (step 712). If this query is answered negatively, then the method ends (step 716). Otherwise, the method continues by providing the player with options for changing one or more play lines 120 during the re-spin (step 720). These options related to pay lines 120 may be provided as part of an additional pop-up window 520 or by highlighting/flashing pay lines 120 that are eligible to be played/evaluated after the re-spin. The option may also be provided by asking the player to provide additional wager credits in exchange for enabling a new pay line 120 that was not previously enabled for the first spin.

The method continues with the game instruction set 220 determining whether the player has selected one or more different pay lines 120 for evaluation after the re-spin (step 724). If the query of step 724 is answered affirmatively, then the game instruction set 220 updates the pay lines 120 that will be evaluated after the re-spin (step 728). In some embodiments, pay lines 120 added for evaluation after the re-spin may be highlighted in the same or a different manner than the pay lines 120 that were originally selected for evaluation after the first spin.

After step 728 or if the query of step 724 is answered negatively, the method continues with the game instruction set 220 calling the symbol lock instruction set 228, which provides the player with options for the selection of symbols to lock during the re-spin (step 732). Any type of user interface element described in FIGS. 4A-5E may be used in this step. The player selection is received (step 736) and the symbol lock instruction set 228 then provides the game instruction set 220 with an indication of the symbols 316 that will be locked during the re-spin (step 740). The game instruction set 220 may then initiate the re-spin such that symbols 316 not subject to the lock feature will be exchanged for new symbols 316, depending upon operations of the game instruction set 220 and, at least in part, based on the output of the random number generator 232. The game instruction set 220 may then evaluate the position of symbols across the selected pay line(s) 120 after the re-spin is complete (step 744). In some embodiments, the game instruction set 220 may determine whether the re-spin resulted in a predetermined set of symbols 316 landed on a pay line 120 subject to evaluation to determine whether the re-spin results in a predetermined game outcome.

Figure 8:
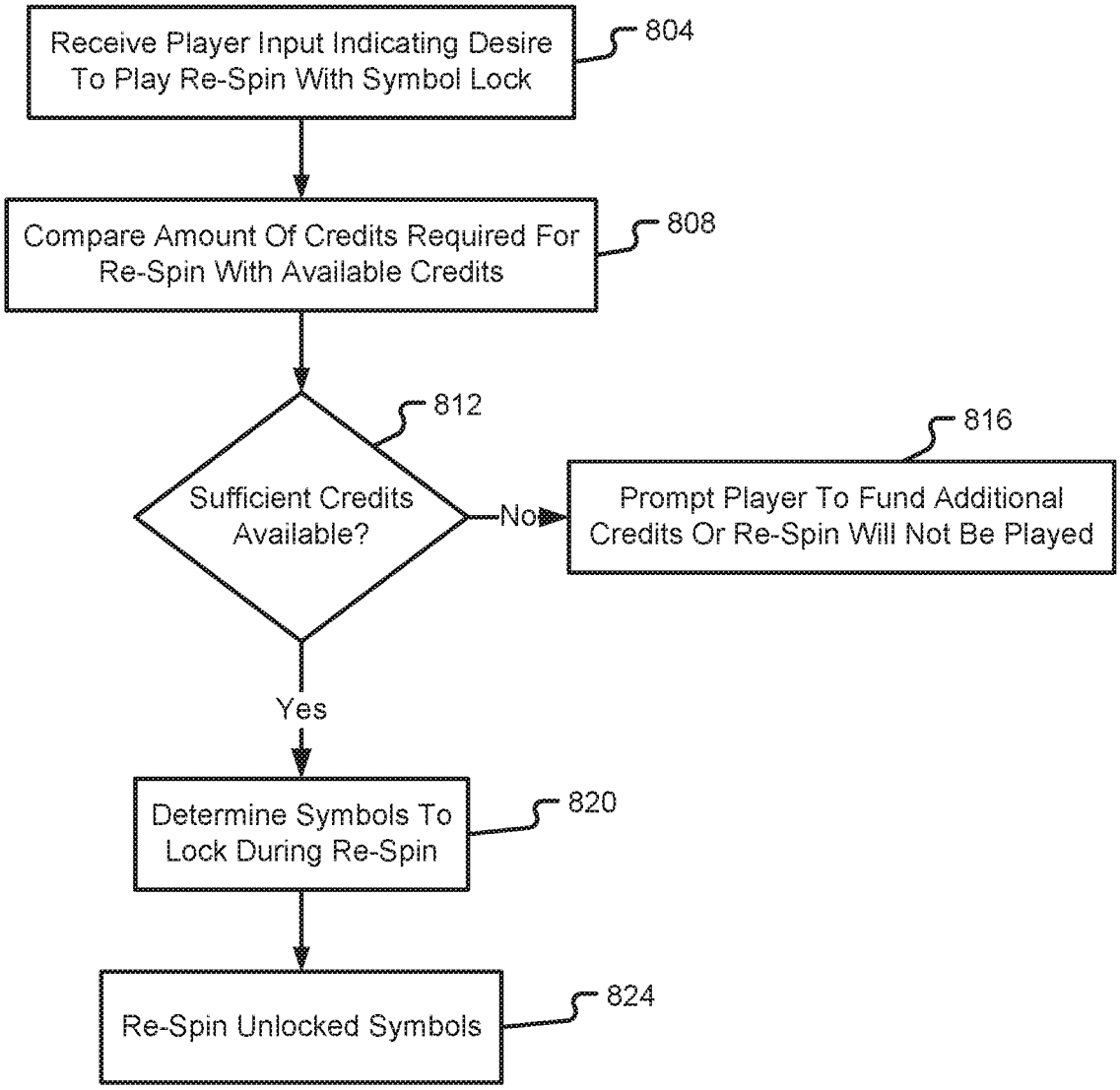
FIG. 8 is a flow chart illustrating a method of confirming availability for a re-spin with a symbol lock in accordance with embodiments of the present disclosure.

With reference now to FIG. 8, a method of confirming availability for a re-spin with a symbol lock will be described in accordance with embodiments of the present disclosure. The method begins when the game instruction set 220 receives a player input indicating a desire to play a re-spin opportunity with the symbol lock function invoked by the symbol lock instruction set 228 (step 804). Prior to enabling the re-spin with the symbol lock function, the game instruction set 220 compares the amount of credits required for the re-spin with a number of credits available in the wager credit meter 224 (step 808).

Based on the comparison of the required credits with the number of credits available in the wager credit meter 224, the game instruction set 220 determines whether there are a sufficient number of credits available to enable the re-spin opportunity (step 812). If there are an insufficient number of credits available, then the player may be prompted to fund additional credits or the re-spin will not be played (step 816). As can be appreciated, such a prompt may be provided in the form of a pop-up window or by highlighting a credit button provided on the computational device 100.

If the game instruction set 220 determines that a sufficient number of credits are available or the player responded to the prompt of step 816 by funding additional credits, the method may then continue with the game instruction set 220 calling the symbol lock instruction set 228 to determine which symbols are to be locked during the re-spin (step 820). This particular step may be performed as described in connection with FIGS. 6 or 7. Once the appropriate symbols have been locked by the symbol lock instruction set 228, the method continues with the game instruction set 220 re-spinning the unlocked symbols (step 824).

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The invention is claimed as follows:

1. A method of operating a computational device, the method comprising:

initiating a first reel spin in which a random number generator is used to determine a position of a first reel and a second reel after spinning the first reel and the second reel;

after the first reel spin, displaying a first set of symbols with the first reel and a second set of symbols with the second reel;

after the first reel spin, determining, with a processor of the computational device, that a re-spin is available;

determining, with the processor, that a symbol lock function will be implemented during the re-spin;

in response to determining that the symbol lock function will be implemented, preventing the second reel from being selected for the symbol lock function based, at least in part, on a determination that the second set of symbols comprises a bonus symbol; and selecting, with the processor, the first reel to remain locked during the re-spin;

initiating the re-spin in which the random number generator is used to spin the second reel but not the first reel; and after the re-spin, displaying the first set of symbols with the first reel and a third set of symbols with the second reel, wherein the third set of symbols is different from the second set of symbols; and evaluating, with the processor, the first set of symbols and the third set of symbols relative to a pay line to determine whether the re-spin results in a predetermined game outcome.

2. The method of claim 1, further comprising:

providing a prompt, with a user output device of the computational device, to indicate that the re-spin is available; and receiving, at the processor, a response to the prompt indicating that a player desires to initiate the re-spin.

3. The method of claim 2, wherein the response to the prompt comprises a player selection of the first reel being a desired reel to lock during the re-spin.

4. The method of claim 2, wherein the response to the prompt comprises a player selection to provide additional game credits to enable the re-spin, the method further comprising:

comparing, with the processor, an amount of game credits included in the player selection with an amount of available game credits stored in a credit meter;

determining, with the processor, that the amount of game credits included in the player selection is satisfied by the amount of available game credits stored in the credit meter; and permitting the re-spin in response to determining that the amount of game credits included in the player selection is satisfied by the amount of available game credits stored in the credit meter.

5. The method of claim 2, wherein the response to the prompt comprises a user selection of the pay line to evaluate after the re-spin, wherein the pay line evaluated after the re-spin is different from a pay line evaluated after the first reel spin.

6. The method of claim 1, wherein the first set of symbols comprises at least three symbols, wherein the second set of symbols comprises at least three symbols, wherein the random number generator is also used to spin a third reel during the re-spin, the method further comprising:

after the re-spin, displaying a fourth set of symbols with the third reel; and including the fourth set of symbols in the evaluation related to the pay line to determine whether the re-spin results in the predetermined game outcome.

7. The method of claim 1, wherein the predetermined game outcome comprises winning a predetermined number of credits, the method further comprising:

incrementing, with the processor, a credit meter of the computational device with the predetermined number of credits.

8. The method of claim 1, wherein the first reel comprises a first virtual reel displayed by a user interface of the computational device and wherein the second reel comprises a second virtual reel displayed by the user interface of the computational device.

9. The method of claim 1, wherein the first reel comprises a first mechanical reel and wherein the second reel comprises a second mechanical reel positioned adjacent to the first mechanical reel.

10. A computational device, comprising:

a user interface;

a processor coupled with the user interface; and a computer-readable storage medium, coupled with the processor, comprising instructions that are executable by the processor, wherein the instructions comprise instructions to:

initiate a first reel spin in which a random number generator is used to determine a position of symbols within an array of symbol areas, wherein the array of symbol areas comprises a first row of symbol areas and a second row of symbol areas;

present, via the user interface, the array of symbol areas with symbols positioned according to the first reel spin;

after the first reel spin, evaluate the position of symbols within the array of symbol areas to determine that a re-spin is available;

determine that a symbol lock function will be implemented during the re-spin;

based on the determination that the symbol lock function will be implemented, prevent the second row of symbol areas from being locked during the re-spin based, at least in part, on a determination that the second row of symbol areas comprises a bonus symbol; and identify the first row of symbol areas as a row of symbol areas that will remain locked during the re-spin;

initiate the re-spin in which the random number generator is used to populate the second row of symbol areas with new symbols but maintain symbols in the first row of symbol areas according to the first reel spin; and after the re-spin, evaluate symbols in the array of symbol areas relative to a pay line to determine whether the re-spin results in a predetermined game outcome.

11. The computational device of claim 10, wherein the instructions further comprise instructions to:

provide a prompt, via the user interface, to indicate that the re-spin is available; and receive a response to the prompt indicating that a player desires to initiate the re-spin.

12. The computational device of claim 11, wherein the response to the prompt comprises a player selection of the first row of symbol areas being a desired row of symbol areas to lock during the re-spin.

13. The computational device of claim 12, wherein the instructions further comprise instructions to:

detect a swipe gesture of the player across the first row of symbol areas and, in response to detecting the swipe gesture of the player across the first row of symbol areas, cause the first row of symbol areas to be identifies as the row of symbol areas that will remain locked during the re-spin.

14. The computational device of claim 10, wherein the first row of symbol areas comprises at least three symbol areas.

15. A system, comprising:

a processor; and a computer-readable storage medium, coupled with the processor, comprising instructions that are executable by the processor, wherein the instructions comprise instructions to:

initiate a first reel spin in which a random number generator is used to determine a position of symbols within an array of symbol areas;

present the array of symbol areas with symbols positioned according to the first reel spin;

after the first reel spin, evaluate the position of symbols within the arrayof symbol areas to determine that a re-spin is available;

determine that a symbol lock function will be implemented during the re-spin;

based on the determination that the symbol lock function will be implemented during the re-spin, prevent a first plurality of adjacent symbol areas from being locked during the re-spin based, at least in part, on a determination that the first plurality of adjacent symbol areas comprises a bonus symbol; and identify a second plurality of adjacent symbol areas as a set of symbol areas that will remain locked during the re-spin;

initiate the re-spin in which the random number generator is used to populate symbol areas other than the set of symbol areas with new symbols; and after the re-spin, evaluate symbols in the arrayof symbol areas relative to a first pay line to determine whether the re-spin results in a predetermined game outcome.

16. The system of claim 15, wherein the second plurality of adjacent symbol areas comprises a column of symbol areas that will remain locked during the re-spin and wherein the column of symbol areas comprises a reel of symbols.

17. The system of claim 16, wherein the reel of symbols comprises a virtual reel and wherein the column of symbol areas comprises at least three symbol areas.

18. The system of claim 15, wherein the instructions further comprise instructions to:

after the first reel spin and before the re-spin, evaluate the symbols in the array of symbol areas relative to a second pay line that is different from the first pay line to determine whether the first reel spin results in the predetermined game outcome, wherein the predetermined game outcome comprises winning a predetermined number of credits.

* * * * *